United States Patent [19]

Kelly

[11] Patent Number: 4,763,446

[45] Date of Patent: Aug. 16, 1988

[54] LOW SOUND, THERMAL AND AIR PENETRATION SLIDING WINDOW

[76] Inventor: Donald V. Kelly, 15903 Condor Ridge Rd., Canyon Country, Calif. 91351

[21] Appl. No.: 904,174

[22] Filed: Sep. 5, 1986

[51] Int. Cl.[4] ..... E05D 15/14

[52] U.S. Cl. ..... 49/407; 52/207

[58] Field of Search ..... 52/207; 49/407, 449, 49/450, 425

[56] References Cited

U.S. PATENT DOCUMENTS 2,867,860 1/1959 Anderson ..... 52/207

3,111,726 11/1963 Grossman ..... 49/425

*Primary Examiner*—Kenneth J. Dorner

*Assistant Examiner*—Gerald A. Anderson

*Attorney, Agent, or Firm*—John E. Wagner

[57] ABSTRACT

A sliding window to be installed in a rough frame opening in a wall. The window comprising a frame including a sill, header, two jamb members and a removable mullion. Contained in the frame are a fixed panel and a sliding panel. A locking handle is provided for the sliding panel. More importantly the removable mullion allows the fixed panel to be secured in the left or right hand side of the frame as desired. Seals and frame features prevent air and sound leakage particularly under stress from a heavy wind. Also disclosed is an anti-lift stop device to prevent removal of the movable panel.

3 Claims, 4 Drawing Sheets

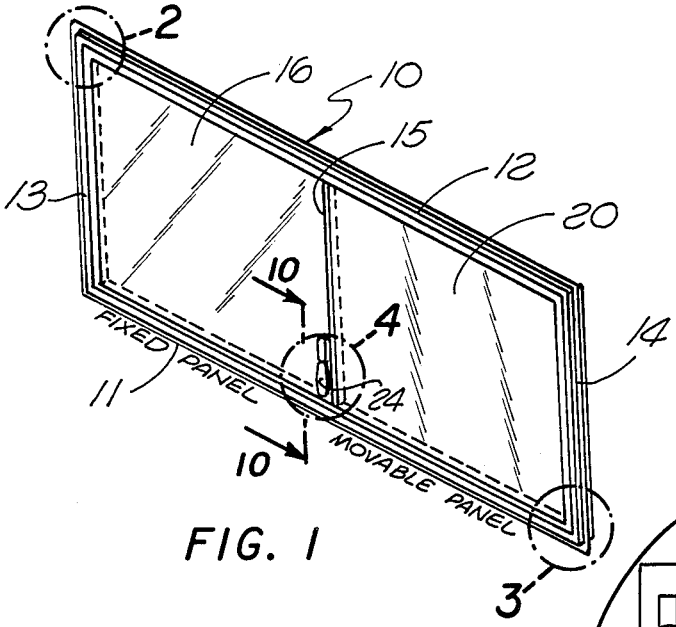
FIG. 1
FIG. 2
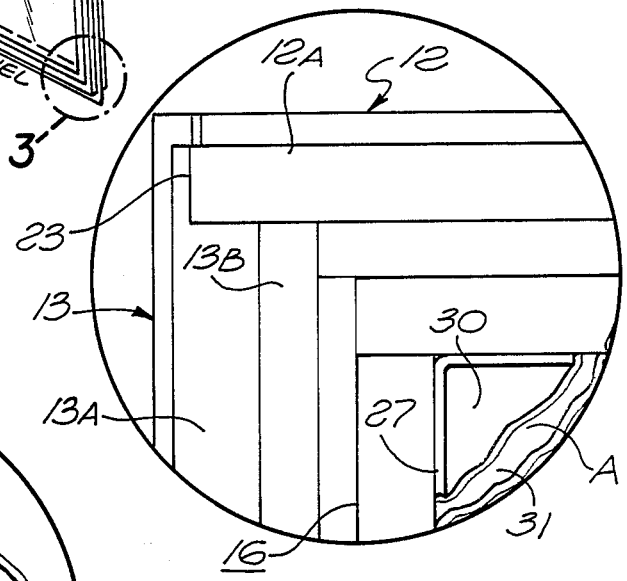
FIG. 4
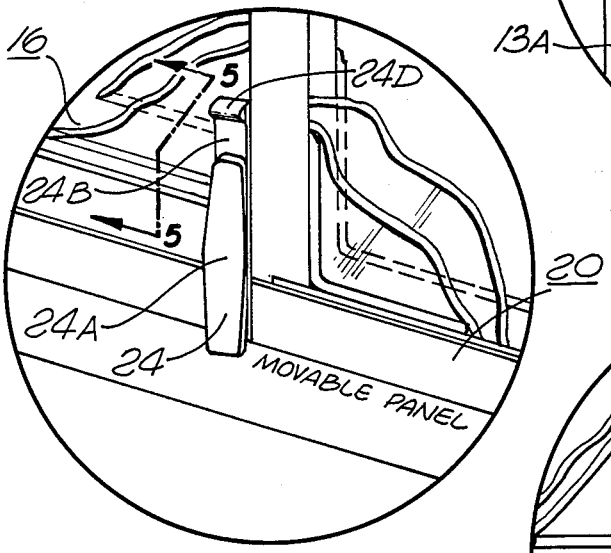
FIG. 3
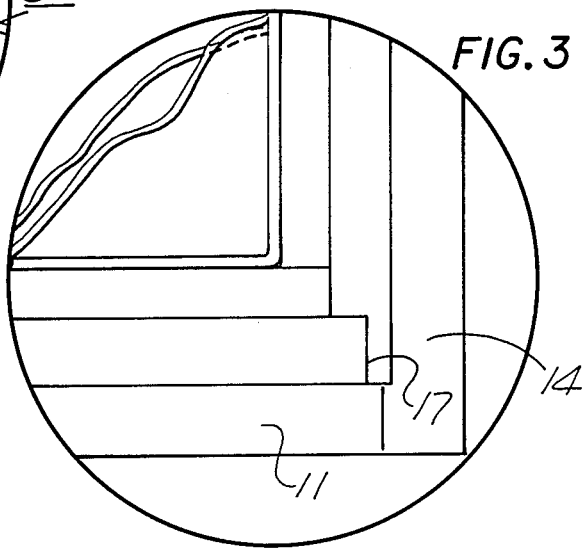
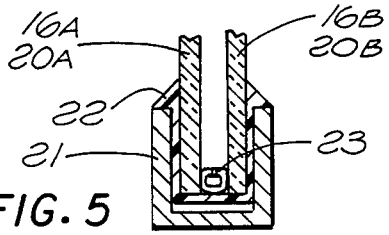
FIG. 5

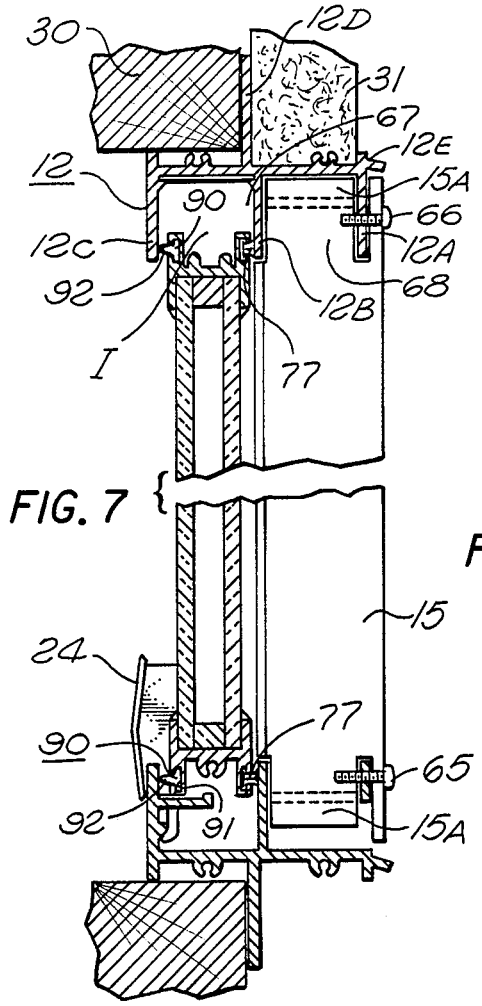
FIG. 7
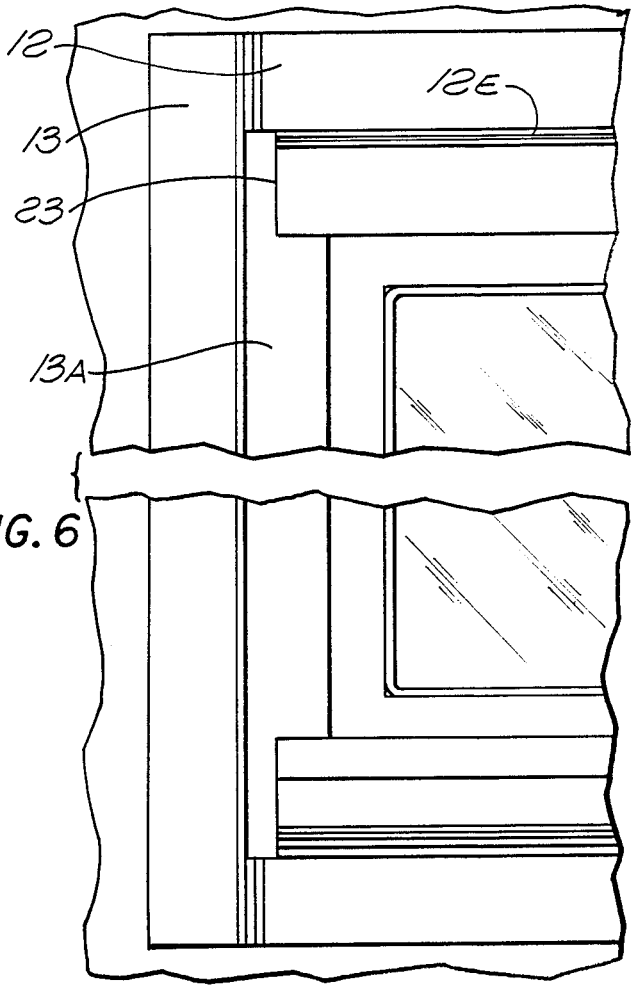
FIG. 6
FIG. 9
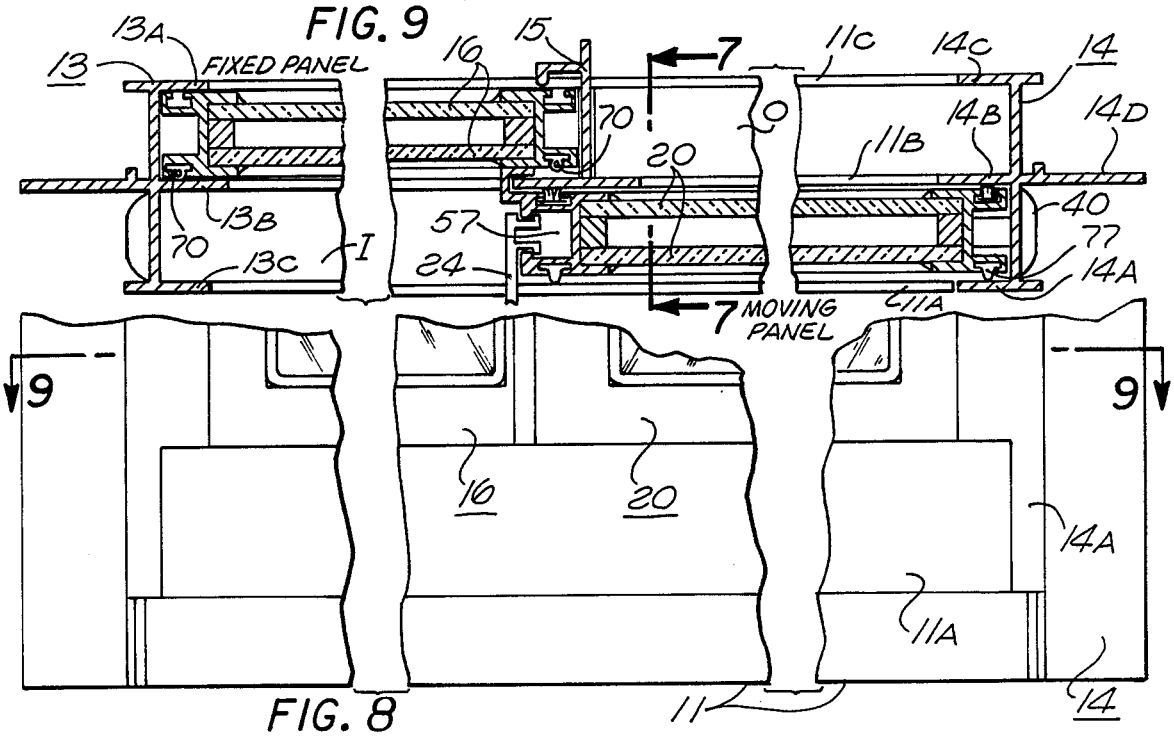
FIG. 8

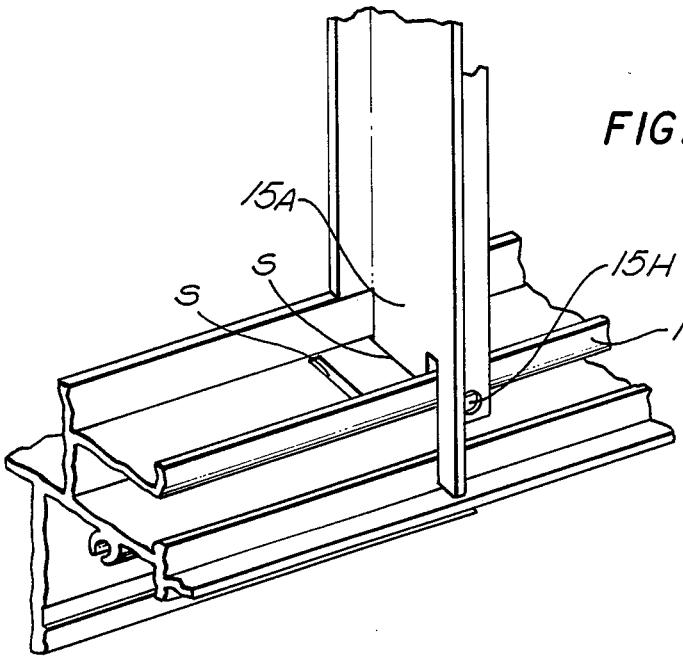
FIG. 16
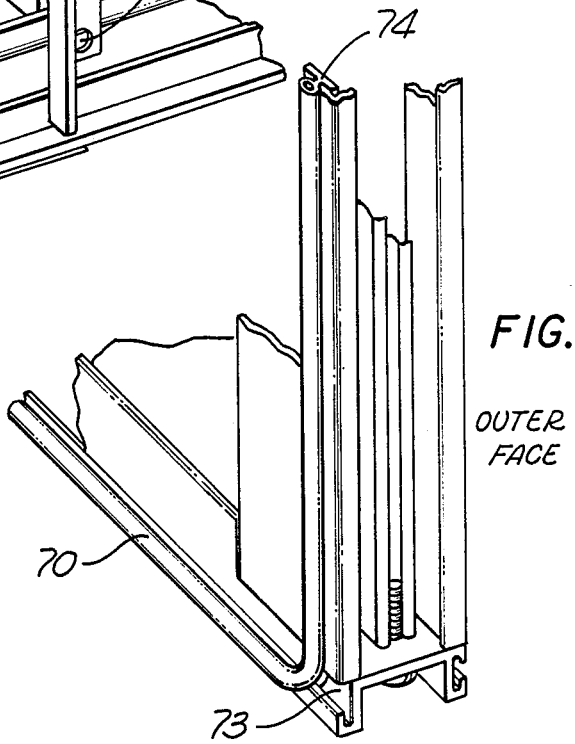
FIG. 17
FIG. 18
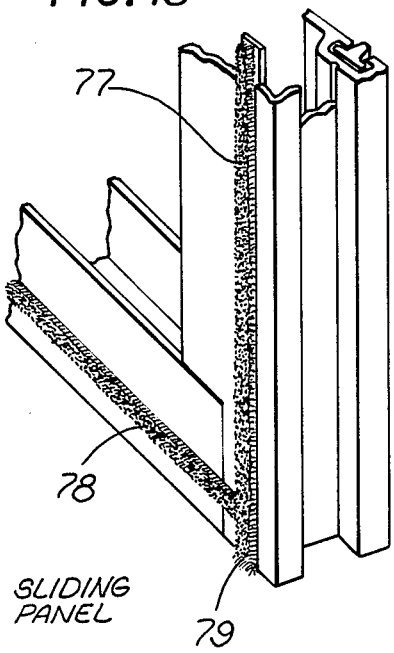
FIG. 19
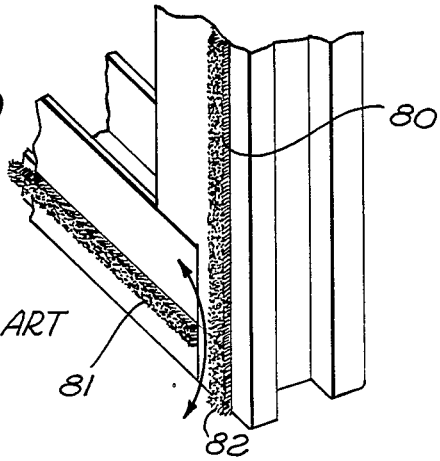

LOW SOUND, THERMAL AND AIR PENETRATION SLIDING WINDOW

BACKGROUND OF THE INVENTION

In recent years increased attention has been directed toward both decreased noise pollution and energy conservation in buildings and homes. Numerous studies have shown that principal offenders in unwanted sound transmission and energy loss in buildings and homes are the window areas.

Improved insulation in walls and ceilings has made measurable improvements in the sound and energy integrity of existing and new construction leaving the window areas as the places requiring major redesign in order to meet acceptable standards. A first major step was taken when single glazing is replaced by dual glazing with an air space between the two window lites. The air space and the second lite will typically reduce the sound transmission through a typical residential window and the thermal energy by significant amounts resulting in widespread adoption of dual glazing.

It has more recently been recognized that a major source of loss of energy through a typical horizontal sliding window even using dual glazing is via air infiltration through the window around the movable sash. The common approach to the minimization of air infiltration has been to install pile fabric type seals similar to the type long used for auto window sealing. In autos such seals have met existing needs and such seals have been considered acceptable in building window installations.

For many years, a window which under test conditions passed less than 0.75 cubic foot of air per minute with a standard pressure differential was considered satisfactory. More recently, standards of 0.50 and 0.37 cubic foot per minute of air infiltration have been established by such organizations as the Aluminum Architectural Manufacturer's Association.

Also, the sound transmission class (STC rating) of a window is important, particularly in noisy locations. Heretofore a rating of 30 could only be achieved using dual glazing. However, I have determined that it is possible to match that standard using only single glazing, or exceed that standard with dual glazing, provided the improved panel mounting and sealing features which I have developed are used.

BRIEF DESCRIPTION OF THE INVENTION

I have carefully analyzed the best of the available sliding windows and in the process have discovered that existing steps toward reducing sound and air infiltration and consequent energy loss have been misdirected. The addition of heavier pile insulation seals only serves to produce a larger gap between the movable sash and the frame. Likewise the practice of forming linear grooves in the faces of window frames and inserting strip pile insulation segments leaves a gap at each corner which produces undesirable air infiltration.

I have further discovered that a major cause of air infiltration and possibly sound transmission is bowing of the windows under heavy wind or pressure differential conditions which allows the air to pass between the fixed and movable sections of the window, particularly between the guides which are commonly found in modern windows.

On further investigation, I have discovered that a simple change in the corner design results in a significant reduction in air infiltration and sound transmission.

One of the major reasons for the existing relatively loose fit of movable sash in sliding windows is so that older ladies or children can still slide the window with ease. This requirement has made the sealing more difficult and has caused compromise in the design. I have achieved such improved sealing while maintaining ease of operation.

I have further designed a roller assembly which may be installed, lubricated, removed and serviced easily without removal of the sash from the frame, and which further allows closer fitting of the movable sash and thus better sealing of the movable sash. Incidently in this design I have also provided a stretch formed recess in the jambs allowing the closer fitting of the movable sash and more compact design. I have also incorporated and improved anti-liftout feature into my window which adds to the security of this window.

BRIEF DESCRIPTION OF THE DRAWING

FIG. 1 is a perspective view of a horizontally sliding window incorporating this invention as seen from the inside;

FIG. 2 is a fragmentary elevational view of the upper left hand corner detail of the window of FIG. 1;

FIG. 3 is a front elevational view of the lower right corner of the window of FIG. 1;

FIG. 4 is a fragmentary perspective view of the center mullion, sliding sash and locking handle detail of the window of FIG. 1;

FIG. 5 is a fragmentary vertical sectional view of a window lite taken along line 5—5 of FIG. 4;

FIG. 6 is a fragmentary elevational view of the left jamb of the window of FIG. 1;

FIG. 7 is a fragmentary vertical sectional view of the center portion of the window of FIG. 1 taken along line 7—7 of FIG. 9;

FIG. 8 is a fragmentary front elevational view of the sill portion of the window of FIG. 1;

FIG. 9 is a horizontal sectional view of the sill portion of the window of FIG. 1 taken along line 9—9 of FIG. 8;

FIG. 16 is a fragmentary perspective view of the mullion-sill member assembly;

FIG. 17 is a fragmentary perspective of a fixed panel corner illustrating the continuous sealing feature;

FIG. 18 is a fragmentary perspective view of a corner of a sliding panel as seen from the outside; and FIG. 19 is a fragmentary perspective view of a typical prior art corner joint of a sliding panel viewed from the exterior.

DETAILED DESCRIPTION OF THE INVENTION

Figure 12:
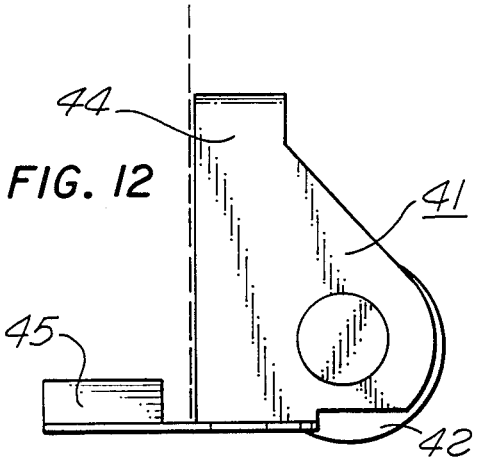
FIG. 12 is an enlarged side view of the roller assembly of this invention.

This invention is best illustrated as applied to a sliding windows for use in homes, apartments or businesses and designed to be installed in a rough framed opening in a wall. Such a window assembly 10 is illustrated in FIG. 1 as viewed from the inside. The window includes a sill member 11, a header member 12, a left jamb 13 and a right jamb 14. A mullion 15 completes the frame elements. These are typically produced from extruded aluminum sections, mitered, notched and assembled by screws into a rigid frame. Contained within the frame is a fixed panel having its own frame which is more clearly visible in FIG. 5, and a similar movable frame 20. As indicated above and visible in FIGS. 2–5, both the fixed panel 16 and the movable panel 20 are double glazed. That is, as illustrated partially in FIG. 5, they have a frame channel 21 with a vinyl liner strip 22 groove and two window lites, 16 A–B or 20 A–B, and a spacer 23 separating each lite from the other by approximately ¼ of an inch. This spacing is dead air space and forms the major thermal insulation of the window 10.

Figure 10:
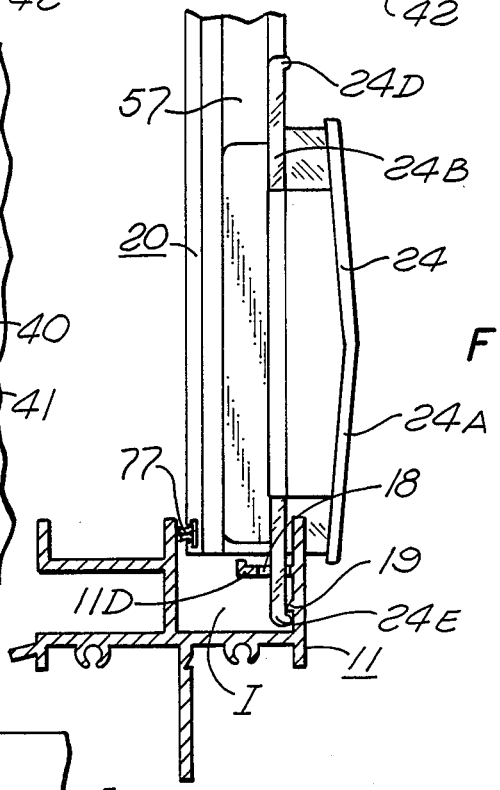
FIG. 10 is a vertical sectional view of the center interlock section taken along lines 10—10 of FIG. 4.

The movable panel 20 is opened, closed and locked by the vertically sliding locking handle 24, better seen in FIGS. 4 and 10.

The features of this invention which reduce the quantity of leakage air flow through the window of FIG. 1 are not even apparent in FIG. 1 and therefore do not detract from the attractive appearance of the window.

Now referring to FIG. 2, in conjunction with FIGS. 6, 7, and 9, a typical corner joint may be seen including the left jamb 13 and the header 12 including a butt joint 23 and the outer flanges 13A and 12A respectively which provide an attractive appearance of depth for the window. A pair of middle flanges, 12B and 13B behind outer flanges 12A or 13A, which do not appear in FIG. 2 but may be seen in FIGS. 7 and 9, define a track or recess for the fixed panel 16. The flanges 12A and 12B as well as flanges 13A and 13B define an outer recess identified as recess "O" in FIGS. 7 and 9. A third set of flanges 12C and 13C, respectively, define with their mating B flanges, an inner recess "I". Either the left end or the right end of the recess "O" will hold the fixed panel 16, and the opposite end of recess "I" will allow slidable movement of the movable panel 20.

In the window of FIG. 1, the right hand panel 20 is movable to the left for ventilation.

The header member 12, in addition to the flanges 12 A–C includes, as is shown in FIG. 7, a framing flange 12D which extends upward in front of the window rough framing header 30 and is secured to header 30 by screws or nails before the finish exterior 31, i.e. stucco, is applied. A drip cap 12E appearing in FIGS. 6 and 7 is present to overhang the window and allow any moisture which runs down the face of the exterior 31 to drip off and not streak the windows.

The bottom corner joints are illustrated in FIGS. 3 as well as FIGS. 6–9. The right jamb 14 and sill member 11 have a mitered joint 17. The sill member 11 has three upward extruding flange 11 A–C corresponding to flanges 12 A–C of header member 12. Jamb member 14 includes flanges 14 A–C defining the recesses "O" and "I" with the members 11, 12 and 13 and includes a framing flange 14D.

Figure 11:
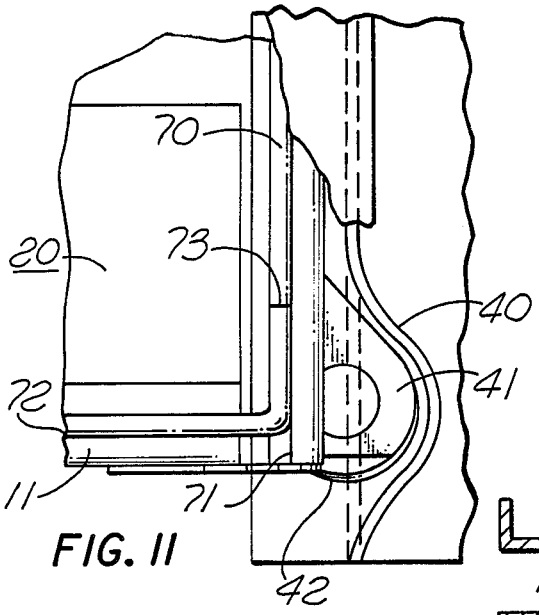
FIG. 11 is a fragmentary front elevational view of the right end section of the sill portion of the window of FIG. 1 with portions broken away to show the roller assembly.

Largely hidden behind flange 14A of jamb member 14 is a stretch formed recess 40 appearing in FIGS. 8, 9 and 11. This recess 40 is formed by stamping into opposite ends of the extrusion which forms either the left or right jambs 13 or 14. It does not interfere with the finished appearance but allows the roller 41 to extend to the right and produce a minimum of elevation of the movable panel 20. By providing the recess 40 at the bottom of each jamb adjacent to recess "I", the moving panel 20, when closed, closely engages the jamb and largly fills the vertical recess "I" of the jamb for better sealing and a more rigid structure. As an ancillary benefit, the length of flanges 14 A–C and their counterparts, 13 A–C may be reduced in length with a substantial saving in metal yet producing a better all around window. This is best illustrated in FIGS. 9 and 11 and contrasts with prior art roller assemblies in which the rollers extend principally below the window and require removal of the window for replacement and further complicate provision of anti-lift protection.

ROLLER ASSEMBLY

Figure 13:
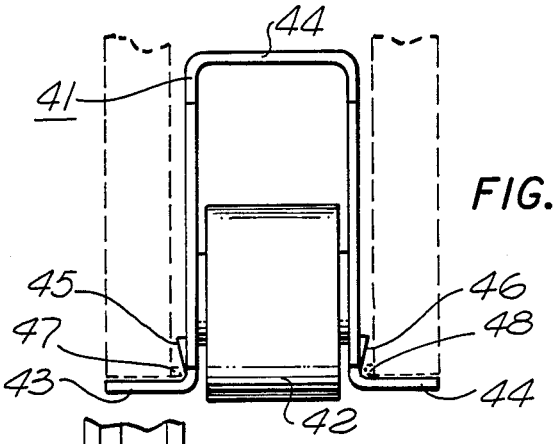
FIG. 13 is a fragmentary front elevational view thereof.

The features of this improved roller are illustrated in FIGS. 11–13. In FIG. 11, the lower right inside corner of window 10 is illustrated with the panel 20 fully closed. The roller assembly 41 extends into recess 40 with the roller wheel 42 extending approximately ⅛ inch below the movable panel 20 and rolls on the bottom of the recess "I" in sill member 11. The roller assembly supports the panel 20 on its edge flanges 43 and 44 which are formed integrally with it U shaped body portion 44. Locking tabs 45 and 46, best seen in FIGS. 12 and 13 engage the inward extending ribs 47 and 48 of the sill member 11 appearing in FIG. 12. The roller assembly 41 may be easily removed and changed by merely inserting a screw driver of prying device between the U shaped body portion 44 and the jamb 14 at the point marked by the arrow in FIG. 12. Removal of the roller 41 also allows the panel 20 to be physically removed from the frame for cleaning.

ANTI-LIFT FEATURE

Figure 14:
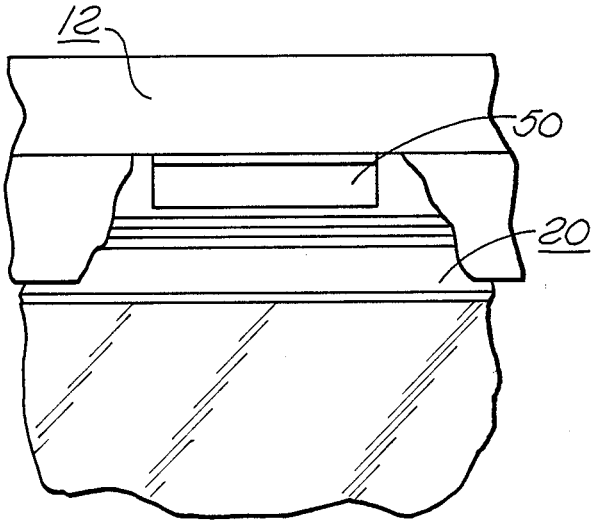
FIG. 14 is a front elevational view of the header portion of the sliding window of FIG. 1 showing the sliding anti-lift stop of this invention.
Figure 15:
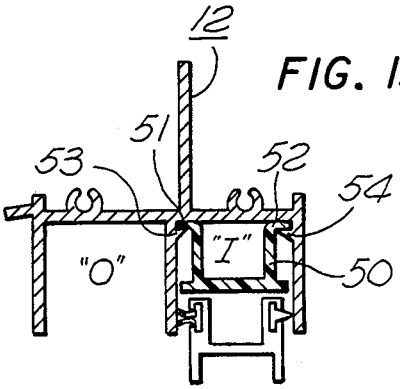
FIG. 15 is a fragmentary vertical section of the header portion of this invention showing the anti-lift stop of FIG. 14.

The movable panel 20 is retained in place against unauthorized removal by anti-lift stop 50 of FIGS. 14 and 15. The stop 50 is preferably an extruded plastic shape as shown in FIG. 15 with feet 51 and 52 which fit under continuous ribs 53 and 54 formed integrally within the recess I of the header member 12. The anti-lift stop 50 is easily snapped into place at any location along the length of the header member 12. The resident may easily slide the anti-lift stop 50 beyond the end of the movable panel to facilitate removal of the panel 20 for cleaning the window. In such case, the roller assembly 41 does not have to be removed. This is in contrast with prior art anti-lift stops which are held in place by glue or screws and not easily removed and replaced by the homeowner.

AIR AND SOUND LEAKAGE SEALING FEATURES

Air and sound leakage is minimized in accordance with this invention due to the presence of a number of features of this invention. First, the mullion 15 of FIGS. 1, 7 and 9 is a stiff aluminum extrusion which is locked to the sill and header members 11 and 12 by interlocking tabs 60 and 61 which extend through slots 62 or 63 in the sill member 11 and similar slots in 64 and 65 in the header member 12. Screws 66 and 65 secure the mullion 15 in place. The mullion 15 rigidifies the frame and provides a solid support for both the fixed and movable panels 16 and 20 when closed.

A truly effective system of edge seals for the panels 16 and 20 is also provided. The fixed panel 16, as illustrated in FIGS. 9–17, includes a tubular flexible seal 70 having an integral flange best seen in FIG. 17 which is locked into the recesses 73–74. The seal 70 is continuous around corners with its end joint in the middle of one of the panel lengths. The outer side of the fixed panel 16 needs no seal since the flexible seal 70 exerts sufficient pressure against the panel 16 throughout its entire periphery to provide an effective, metal to metal face seal. This is best seen in FIG. 9.

Movable panel 20 is sealed by pile type strips 77 on its outer face as illustrated in FIGS. 7, 9 and 18. The strips 77 extend the full length of the vertical panel sides, and the horizontal strips 78, as shown in FIG. 18, extend through notches 79 into contact with the vertical pile seal 77. This is in direct contrast with prior art windows as shown in FIG. 19 in which the seals 80 and 81 do not join, leaving a gap which, unrecognized in the prior art, contributes a major amount to air infiltration and probably to sound transmission.

The inner face of the movable panel 20 includes continuous vinyl strips 90 held in edge slots 91. Strips 90 include a rib 92 which extends the full length of each side. The rib acts as a seal and presents a low friction surface to the window frame 10, and of equal importance, prevents the movable panel 20 from bowing in heavy wind as could occur with prior art sliding windows which only used a pair of plastic buttons at the outside corners of the movable panel.

These seals plus the rigidity of the mullion 15 prevent air leakage. Heretofore, in the absence of a rigid mullion and locking tab, wind pressure could easily cause twisting and bowing of the windows, separation of the seals from their adjacent frame and significant air passage. Altogether these seals cooperate to provide an effective air and sound block for the windows far more efficient than available heretofore.

IMPROVED LOCK

I have a combined handle and lock which further aids in minimizing air leakage. It is best seen in FIGS. 4 and 10. The locking handle 24 includes a handle portion 24A and a body portion 24B having integral detents 24C and 24D, only one of which appears in FIG. 4. This locking handle 24 is slidable in groove 57 of FIGS. 9 and 10, from top to bottom for ease of opening. When lowered to the bottom of groove 57, detent 24E engages a rib 17 in recess "I" of sill member 11. The pile type seal 77 on the outer side of the panel 20 has sufficient resilience, and slideable handle 24 has sufficient clearance to allow the handle detent 24E to slip over the rib 19 of the sill 11. The handle 24 securely locks the window closed or in any of a number of intermediate positions, each identified by a punched opening such as 18 in ledge 11D of the sill member 11. When the handle 24 is engaged as illustrated in FIG. 10, the movable panel 20 may not be moved either from the interior or exterior of the window 10 by force applied to the glass. Only when handle 24 is raised may the window be moved manually.

RIGID FRAME FEATURE

Heretofore, aluminum frame windows have exhibited reasonable rigidity for storage, installation and service. Assembly is accomplished usually by mechanical interconnection using self tapping screws introduced into the jamb member, via holes and engaging continuous extruded "C" shaped recesses such as 67 and 68 of FIG. 7. A mullion, if present, added minor strength to the window.

As I determined, significant bowing of the windows under wind or rain pressure can occur allowing air, or in some cases rain to pass between the bowed panels and the frame. My improved mullion 15 securely locks the frame together and provides a rigid member against which the panels 16 and 20 may seal. Mullion 15, as may be seen in FIGS. 9 and 16, is a combined T and channel shape, both shapes exhibiting effective stiffness.

Of additional importance is the face that mullion 15 extends through punched slots "S" in the header member 12 and sill member 11 as illustrated in FIGS. 7 and 16. The interlocking of the integral tabs 15A with the sill and header members 11 and 12 holds the header and sill members and the mullion 15 securely together. A self tapping screw is driven into pre-drilled hole 15H to complete the assembly. The mullion 15 may be reversed and installed in the other of two pair of slots S to convert the opening of the window from left open (OX) to right open (XO) form.

Altogether, I have produced an improved window assembly which provides effective protection from air and moisture infiltration, superior thermal insulation through the use of dual panels and effective locking from unauthorized opening or removal of the windows.

The foregoing constitute the best mode known by me of carrying out my invention and for that purpose the embodiments shown are merely illustrative of the principle of the invention but are not limiting in its scope. One of ordinary skill in the art could produce other embodiments without departing from the spirit and scope of my invention. Instead, my invention is defined by the following claims including protection afforded by the doctrine of equivalents.

What is claimed is:

1. A sliding window assembly providing improved air and sound infiltration resistance comprising:

a frame including a sill member, a header member and a pair of jamb members defining a generally rectangular frame including a pair of side by side recesses, one outer and one inner, and a pair of framed window panels retained in said frame:

the improvement which comprises a pair of slot openings in said sill and header members said opening being perpendicular to the long dimensions of said sill and header members;

a mullion member generally bisecting said generally rectangular frame and having sufficient rigidity to prevent bowing of said framed panels within said window assembly, said mullion member including integral end tabs extending through said slot openings in said sill and header members thereby defining one edge of said outer recess and securing one of said framed window panels in fixed position; and said framed window panels each including substantially continuous flexible seals on at least one face of the frame thereof which engages the surfaces of said frame and mullion to provide substantially air and water tight relationship between the framed window panels and said rectangular frame when closed.

2. A sliding window assembly in accordance with claim 1 wherein said slots are located in opposed positions in said sill and header members, and wherein a pair of said slots are located in each of the sill and header members whereby the mullion may be reversed and moved to allow either left opening or right opening, horizontally movable window operation.

3. A sliding window assembly in accordance with claim 1 in which one of said framed window panels is fixed in place in said outside recess by said frame members and said mullion and other other of said framed window panels is slidable in said inner recess, and includes a vertically slidble handle secured to one side of said movable window panel;

said slidable handle including an end detent for engaging the sill member of said frame to lock said movable window and said sill member having at least one slot in said inner recess and said handle detent is movable into said slot to engage said sill member and locks said slidable framed window.

* * * * *